US006542440B1

(12) United States Patent
Kihara

(10) Patent No.: US 6,542,440 B1
(45) Date of Patent: Apr. 1, 2003

(54) POWER-SAVING ELECTRONIC WATCH AND METHOD FOR OPERATING ELECTRONIC WATCH

(75) Inventor: Hiroyuki Kihara, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/582,019

(22) PCT Filed: Oct. 20, 1999

(86) PCT No.: PCT/JP99/05782

§ 371 (c)(1),
(2), (4) Date: Jun. 20, 2000

(87) PCT Pub. No.: WO00/23852

PCT Pub. Date: Apr. 27, 2000

(30) Foreign Application Priority Data

Oct. 20, 1998 (JP) ..... 10-297870

(51) Int. Cl.[7] ..... G04F 5/00; G04B 1/00
(52) U.S. Cl. ..... 368/204; 368/156
(58) Field of Search ..... 368/22, 64, 66, 368/203, 204, 156; 268/76

(56) References Cited

U.S. PATENT DOCUMENTS 3,828,278 A * 8/1974 Rees ..... 368/187
3,939,644 A * 2/1976 Wolf ..... 368/187
4,177,632 A * 12/1979 Burki et al. ..... 368/187
4,615,625 A * 10/1986 Moriya ..... 368/204
6,118,258 A * 9/2000 Farine et al. ..... 368/64

OTHER PUBLICATIONS

Ushigo et al., Analogue Electronic Timepiece, Jan. 1985, JP360015584, abstract.*

* cited by examiner

*Primary Examiner*—Vit Miska
*Assistant Examiner*—Jeanne-Marguerite Goodwin
(74) *Attorney, Agent, or Firm*—Greer, Burns & Crain, Ltd.

(57) ABSTRACT

When the stem of an electronic watch such as one using a quartz oscillator circuit is pulled out, a switch operates so that the hands stop while the oscillation continues, thereby reducing the current consumption. The watch may be stored in this condition and, to achieve an even further power savings, a counting circuit is provided counts and, when a given amount of time has elapsed after the stem is pulled out, a signal is output, so as to stop both oscillation and frequency dividing. Additionally, a pull-down resistance connected to the switch is made by two transistors having a large and a small resistance values, with the above-noted signal being used to cause conduction through only the transistor with the large resistance value when in the power-saving condition, so that current in that part is small. Alternately, a circuit is provided for storage while in the power-saving condition, in which the transistor of the pull-down resistance is made non-conducting, so that current does not flow, with the switch being provided with a center contact that, when the stem is pushed in, operates so as to erase the memory and to cause the transistor to conduct, thereby resulting in a return to normal operation.

18 Claims, 7 Drawing Sheets

POWER-SAVING ELECTRONIC WATCH AND METHOD FOR OPERATING ELECTRONIC WATCH

FIELD OF THE INVENTION

The present invention relates to an electronic watch having electronic circuits such as an oscillator circuit, a frequency dividing circuit, and a drive circuit, and which is driven by an internal battery power supply.

BACKGROUND ART

At present, electronic watches having a power supply and an electronic circuit, and particularly those using a quartz oscillator circuit as a reference time base, are in wide use. FIG. 4 shows examples of electronic watches, (a) showing an analog watch, in which the time is indicated by an hour hand 1, a minute hand 2, and a second hand 3, and (b) showing a digital watch, in which the hour, minute, second, and calendar are indicated digitally by numerals.

The user pulls out a stem 4 of the watch as shown by 4*a*, and turns the stem so as to set the hands to start using the watch. If time indication becomes skewed after a long period of use, the user must operate the stem 4 to correct the hand positions.

In a general electronic watch, as a convenience in setting the hands, a switch linked to the stem operates when the stem is pulled out to the position 4*a* so as to immediately stop the movement of the hands.

Therefore, the usual procedure for setting the hands is to pull out the stem 4 when the second hand points to 12 o'clock, so as to stop the movement of the hands, and if necessary to rotate the stem in accordance with a time signal from the radio or TV, after which the stem 4 is pushed in to start the movement of the hands. By doing this, even the second hand can be accurately set.

The configuration of an electronic watch such as this is shown in the block diagram of FIG. 5, in which 5 is an oscillator circuit, this generally being a quartz oscillator circuit using a quart oscillating element 6. The oscillator output passes through two stages or a first frequency dividing circuit 7 and a second frequency dividing circuit 8, and is divided thereby down to 1 Hz, which is suitable for driving the second hand.

The frequency-divided output passes through a wave-shaping circuit 9 and is applied to a drive circuit 10, the coil of a motor 11 being thereby excited so as to move the hands 12. Although not shown in the drawing, the motor 11 and the hands 12 are linked by a gear train.

A voltage regulator circuit 13 is provided as a power supply circuit, this being connected to power supply voltages VDD and VSS from a battery, and generating a voltage Vreg, which is lower than the battery voltage.

As shown in the drawing, the oscillator circuit 5 and the first frequency dividing circuit 7 are driven by the output voltage Vreg of the voltage regulator circuit 13, and the second frequency dividing circuit 8 and subsequent circuitry are driven not by Vreg, but rather by a battery voltage.

The reason for driving the oscillator circuit 5 and the first frequency dividing circuit 7 by a specially provided voltage regulator circuit 13 is, because these parts deal with high-frequency signals, to reduce the drive voltage and the power consumption, and also operate the oscillator circuit that determines the accuracy of the watch with good stability, from the output voltage Vref of the voltage regulator circuit 13 that does not vary, even if the battery voltage drops.

The switch SW is constructed so that it operates in concert with the stem 4 shown in FIG. 4. That is, in the condition in which the watch is in use, with the stem 4 pushed in, a switching piece 14 shown in FIG. 5 is moved away from the ON contact 15. The switching piece 14 is connected to the power supply voltage VDD, and the ON contact 15 is connected, via an n-channel transistor Tr1, to the power supply voltage VSS.

The transistor Tr1, being connected to VDD, is always in the conducting state. The transistor Tr1 is a pull-down resistance, which pulls down the potential of the ON contact 15 to VSS. The ON contact 15 is connected to the reset terminal R of the frequency dividing circuit 8, and because this is at a low potential, the second frequency dividing circuit 8 is not reset, and continues to operate.

When the user pulls out the stem to 4*a* as shown in FIG. 4 in order to set the hands, the switching piece 14 of FIG. 5, linked to the stem 4, makes connection with the ON contact 15. When this occurs, the ON contact 15 potential rises from VSS to VDD, so that a valid signal is applied to the reset terminal R of the second frequency dividing circuit 8, thereby stopping the output of the signal from the second frequency dividing circuit 8, so that the motor 11 is no longer driven, thereby stopping the hands 12.

In this condition, when the user sets the hands and pushes in the stem, the switching piece 14 moves away from the ON contact 15, so that the potential on the ON contact, this being the voltage applied to the reset terminal R of the second frequency dividing circuit 8, decreases to VSS, and because the oscillator circuit 5 and first frequency dividing circuit 7 were still in the driven condition, the second frequency dividing circuit 8 reset condition is released, so that it immediately starts again to output a signal, thereby driving the motor 11 and starting the movement of the hands 12.

In this manner, the stoppage of the hands when the stem is pulled out is convenient in setting the hands, and because the motor is not driven, it is possible to greatly reduce the power consumption. Because of this, it possible to prevent wearing down of the battery before a watch is delivered to a user.

For this reason, during the period in the factory, or in a warehouse, or when the watch is being displayed in a shop, the stem is pulled out to stop the hands.

If the stem is pulled out to stop the hands, it is possible to reduce the wear down of the battery because of the reduction in current consumption, although in this condition there is still current consumed by the oscillator circuit and the first frequency dividing circuit. For this reason, in a case, for example, in which a long time elapses before the users receives the watch, there can be a non-negligible depletion of battery.

One approach to achieving a further power savings that can be envisioned is that of not only stopping the hands when the stem is pulled out, but also stopping the oscillator circuit and the first frequency dividing circuit as well, although this approach is not applicable so simply.

The resonant element used in the oscillator circuit is normally a quartz resonant element with a characteristic frequency of approximately 32 kHz, and once the oscillation thereof is stopped, some time is required when restarting the oscillation for the oscillator to build up and become normal. Because of this, when the stem is pushed in, time is required before the circuit operates normally, so that after the stem is pushed in the hands do not move normally one second thereafter, thereby preventing the proper setting of the hands.

The inventors of the present invention, in a previous Japanese Patent Application No. 52-46453 (Japanese Examined Patent Publication (KOKOKU)No. 61-37585) proposed a quartz watch in which, when the stem is pulled out, not only the hands, but also the oscillation is stopped.

In this watch, the number of seconds required for the previously stopped quartz resonant element to reach a sufficient amplitude is priorly predicted, and when the stem is pushed in a drive pulse is first generated for that number of seconds, so as to advance the hands. By doing this, in addition to achieving a power savings greater than in the past when the stem is pulled out, after the stem is pushed in, there is no delay in the time display.

However, while the disclosure of the Japanese Patent Application No. 52-46453 (Japanese Examined Patent Publication (KOKOKU)No. 61-37585) compensates for the. delay in operation startup after setting of the time, it is difficult to adjust the compensation value to the actual delay time, and troublesome processing is required, for example, to select a compensation value appropriate to the quartz resonant element characteristics and the circuit specifications.

In the above-noted electronic watch, it is necessary not only to save power in the case of setting the hands or when the watch is stored for a long period of time, but it is also necessary in the case in which the output voltage of a power supply used in the electronic watch, this being a primary cell, a secondary cell or an electrical generator and a secondary cell falls below a prescribed voltage value, to reduce the decrease in battery capacity, because of the desire to save power used by the electronic watch, and in particular to shorten the amount of time required to charge a secondary cell.

Accordingly, it is an object of the present invention to provide an electronic watch that solves the problems of the prior art, and normally enables hand setting, wherein during storage or when the power supply voltage has dropped below a pre-established reference value, achieves a great power savings, and a method for operating an electronic watch.

DISCLOSURE OF THE INVENTION

In the present invention, in order to achieve the above-noted object, the basic technical constitution adopted is as follows.

Specifically, a first aspect of the present invention is a power-saving electronic watch having a power supply, an oscillator circuit, a frequency dividing circuit, and a drive circuit, this electronic watch further having an externally operable switch and a counting circuit that counts a prescribed time, wherein after the switch goes into the ON condition, and after a prescribed time elapses, minimally the oscillator circuit is stopped.

A second aspect of the present invention is a power-saving electronic watch having a power supply, an oscillator circuit, a frequency dividing circuit, and a drive circuit, this electronic watch further having voltage detection circuit that detects a drop in power supply voltage, wherein an output signal of the voltage detection circuit minimally stops the oscillator circuit.

A third aspect of the present invention is a method for operating an electronic watch having a power supply, an oscillator circuit, a frequency dividing circuit, and a drive circuit, this electronic watch further having an externally operable switch and a counting circuit that counts a prescribed time, wherein after the switch goes into the ON condition, after a prescribed time elapses, minimally the oscillator circuit is stopped, and a method for operating an electronic watch having a power supply, an oscillator circuit, a frequency dividing circuit, and a drive circuit, this electronic watch further having voltage detection circuit that detects a drop in power supply voltage, whereby, in response to detection and output of a signal therefrom, the oscillator circuit is minimally stops the oscillator circuit.

BRIEF DESCRIPTIONS OF THE DRAWINGS

DETAILED DESCRIPTION OF THE PREFERRED EMBODIMENTS

Specific examples of an electronic watch and a method for operating an electronic watch according to the present invention are described in detail below, with reference made to drawings.

Figure 1:
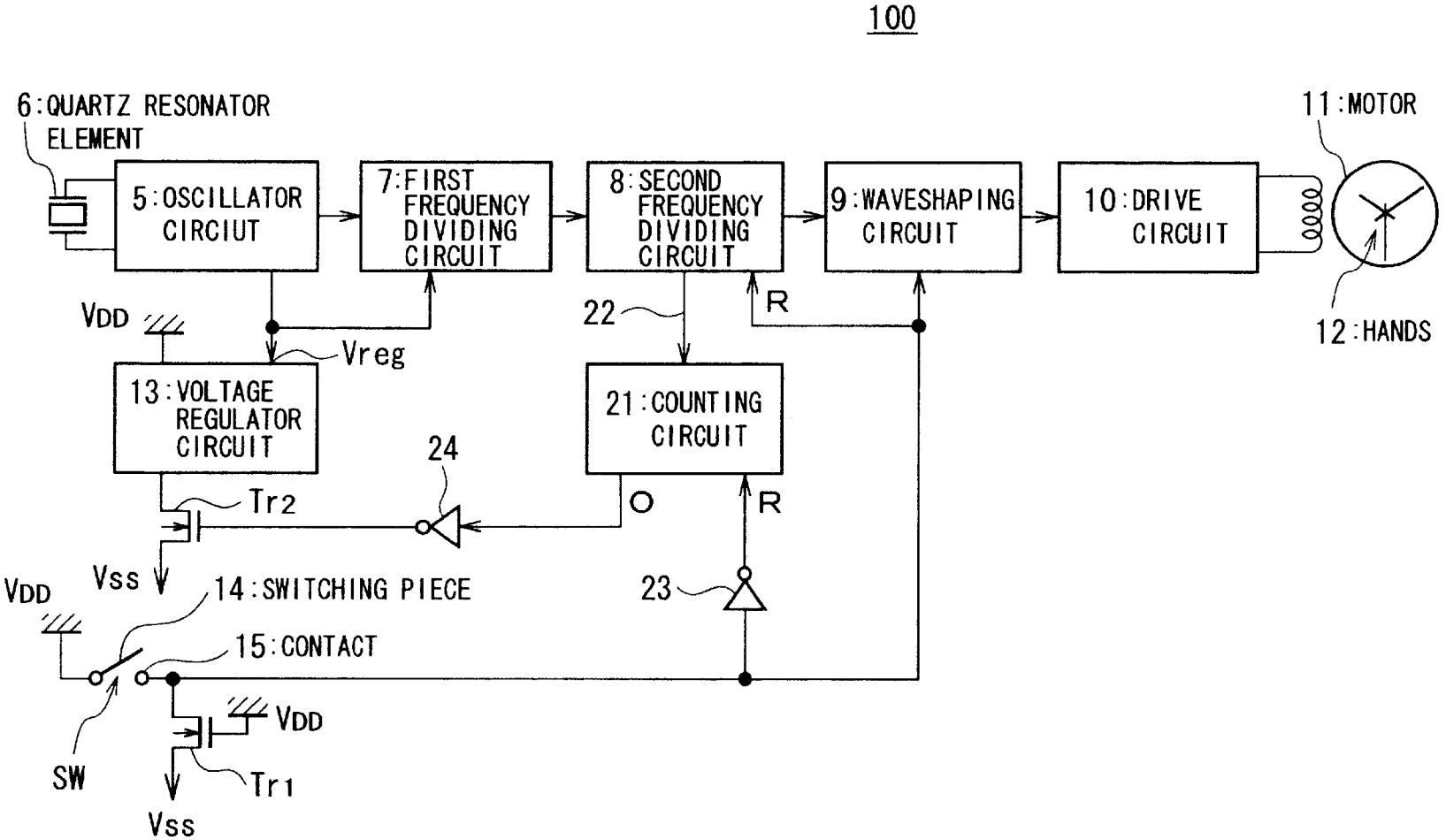
FIG. 1 is a block diagram of a first embodiment of an electronic watch according to the present invention.

Specifically, FIG. 1 is a block diagram showing the configuration of an example of an electronic watch according to the present invention, in which is shown a power-saving electronic watch 100 having a power supply 13, an oscillator circuit 5 including a quartz resonant element 6, frequency dividing circuits 7 and 8, and a drive circuit 10. This electronic watch is also provided with an externally operable switch SW and a counting circuit 21 that counts a prescribed time, wherein when a prescribed time elapses after the switch operates, the power supply operation to at least the oscillator circuit 5 is stopped.

That is, in the above-noted specific example of the present invention, a switch SW linked to a stem 4 is provided, and when the stem 4 is pulled out, the operation of the switch SW stops the movement of the hands, while the oscillation and frequency dividing continues.

After when the stem 4 had been pulled out and then a certain amount of time has elapsed, both the oscillation and the frequency dividing are stopped. Therefore, if storage is done with the stem 4 pulled out, it is possible to maintain a condition in which the current consumption is greatly reduced.

That is, in the present invention, if the stem 4 is pushed the watch 100 starts again. To do this, a counting circuit 21 that achieves a timer function by measuring a certain amount of time is newly provided.

The counting circuit 21 starts counting when the stem 4 is pulled out, and outputs a signal after the elapse of a prescribed amount of time, whereby the operation of the oscillator circuit 5 and the frequency dividing circuits 7 and 8 is stopped.

The setting time of the counting circuit 21 is usually set to a time that is sufficient to allow setting of the hands, this being very short compared to the period of time in a warehouse or period of storage.

Thus, in the present invention, not only the movement of the hands, but also the oscillation and frequency dividing are stopped, thereby achieving a current consumption smaller than in the past, and with the stem 4 being pulled out, current flows in a pull-down resistance connected to the switch SW, the resulting current consumption being greater than the current savings achieved by stopping the oscillation and the frequency dividing.

It is preferable that in the present invention can be configured so that the current consumption by the pull-down resistance is also less than in the past, or even so that absolutely no current flows in the resistance.

Figure 5:
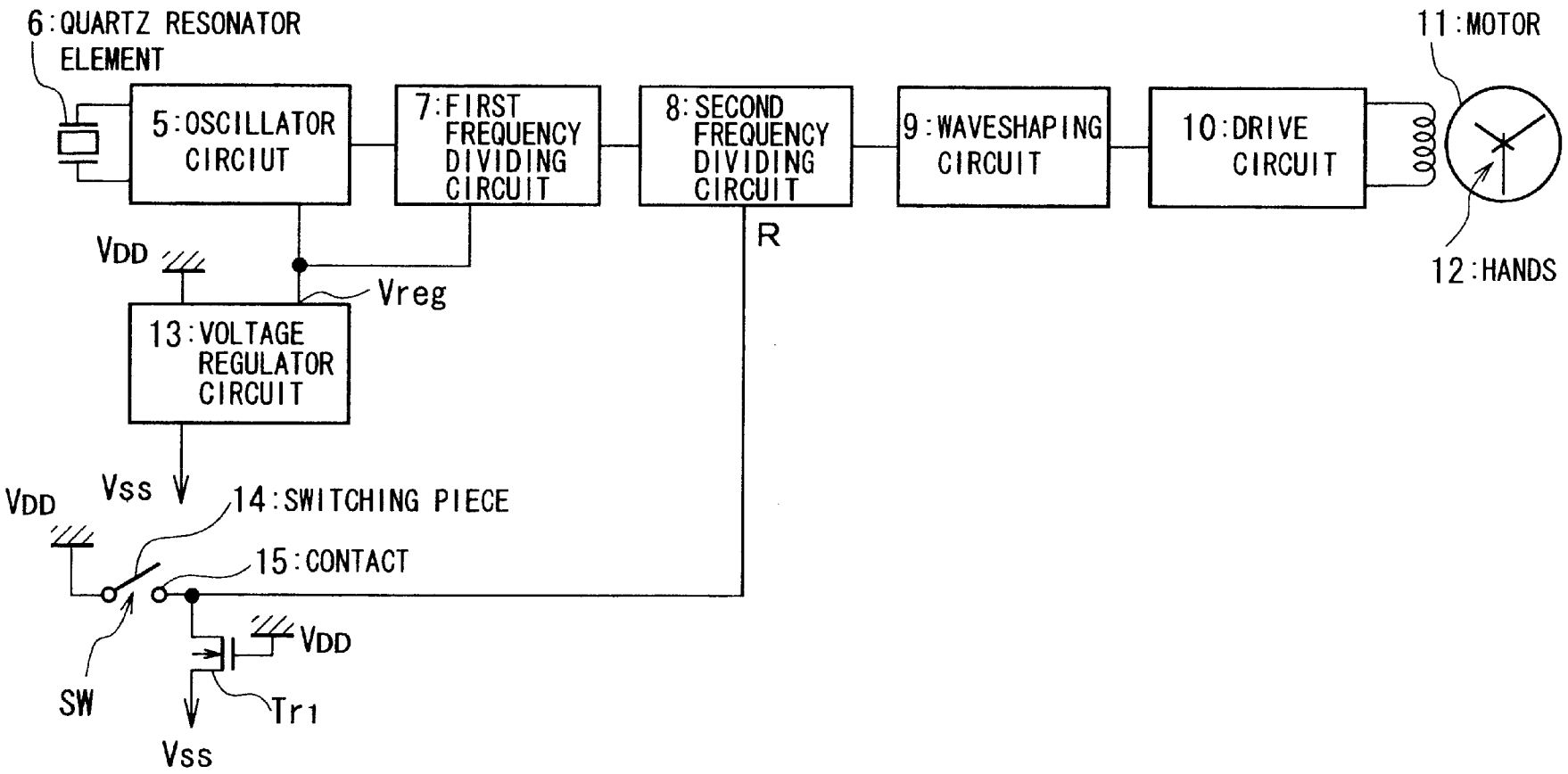
FIG. 5 is a block diagram of an electronic watch of the past.

With regard to a first embodiment of the present invention, more specifically the basic configuration from the oscillator circuit 5 to the hands 12 is the same as in the past, shown in FIG. 5.

It is desirable that the power supply 13 of the present invention being a voltage regulator circuit, the output voltage Vreg of which drives the oscillator circuit 5 and the first frequency dividing circuit 7, the voltage regulator circuit 13 in this case being connected to a power supply voltage VSS via an n-channel transistor Tr2.

Additionally, in the above-noted specific example of the present invention, as is clear from FIG. 1, the basic configuration from the oscillator circuit 5 to the hands 12 is the same as in the past, as shown in FIG. 5.

The output voltage Vreg of the voltage regulator circuit 13 drives the oscillator circuit 5 and the first frequency dividing circuit 7, and in this case the voltage regulator circuit 13 is connected to the power supply voltage VSS via the n-channel transistor Tr2.

In the above-noted example of the present invention, the output 22 of the second frequency dividing circuit 8 is input to a newly provided counting circuit 21. The configuration of the switch SW that is linked to the stem 4 is the same as in the past, the ON contact 15 of the switch SW being connected not to a reset terminal of the second frequency dividing circuit 8 as in the part, but rather a stop terminal D of waveshaping circuit 9, or to the second frequency dividing circuit 8.

This is because even after the stem 4 is pulled out it is necessary to continue operation of the frequency dividing circuits 7 and 8 and to supply the frequency-divided output 22 to the counting circuit 21. The ON contact 15 of the switch SW is connected to the reset terminal R of the counting circuit 21 via an inverter 23. The output terminal 0 of the counting circuit 21 is connected to the gate of the transistor Tr2 which connects the voltage regulator circuit 13 to the power supply voltage VSS, via an inverter 24.

The operation of the circuit is as follows. The switch SW is normally open, and the potential on the ON contact 15 is pulled down to the power supply voltage VSS via the transistor Tr1. When the user pulls out the stem, the switching piece 14 linked thereto is connected to the ON contact 15.

When this occurs, the potential on the ON contact 15 rises to the power supply voltage VDD, this voltage being applied to the stop terminal D of the waveshaping circuit 9, thereby stopping the operation thereof, so that the motor 11 is no longer driven, thereby stopping the hands 12.

As described above, in order to set the hands, the user pulls out the stem when the second hand points to 12 o'clock so as to stop the hands. When the hand setting is completed and the stem is pushed in, so that the potential on the ON contact 15 falls to VSS due to the switch SW being opened, the stopped condition of the waveshaping circuit 9 is cleared.

Because the oscillator circuit 5, the first frequency dividing circuit 7, and the second frequency dividing circuit 8 continue to operate even during the hand setting operation, the watch restarts operation immediately. By doing this, it is possible to set the hands in the same manner as in the past.

In the present invention, after the stem 4 is pushed in, the first frequency-divided output is made after one second, so as to drive the second hand, so that when the configuration of FIG. 1 is implemented, the ON contact 15 is connected to the reset terminal R (refer to FIG. 5) of the second frequency dividing circuit 8 via a differentiation circuit, although a detailed description of this type by design refinement will not be presented herein.

The potential on the ON contact 15 of the switch SW is applied to the reset terminal R of the counting circuit 21 via the inverter 23. When using the watch with the stem in the pushed-in condition, since the switch SW is open resulting in a potential of the ON contact 15 to be reduced to Vss, so that a high voltage (high-level signal) is applied via the inverter 23 to the reset terminal R of the counting circuit 21, thereby resetting the counting circuit 21 so that it does not operate.

When the stem is pulled out to set the hands, thereby closing the switch SW, it is a low-voltage signal (low-level signal) that is applied to the reset terminal R, so that the counting circuit 21 reset condition is released, resulting in the start of counting.

When the elapse of a pre-established amount of time is detected, the counting circuit 21 outputs a detection signal from the output terminal 0 and, because the hand setting and return of the stem usually occurs within the pre-established time, before the counting circuit 21 outputs the detection signal the R terminal once again changes to a high-level, so that reset is made, thereby returning the watch to normal operation.

In order to store the watch in a power-saving condition, the stem is left pulled out. Because a low-level is applied to the reset terminal R of the counting circuit 21 simultaneously with the pulling out of the stem, the counting circuit 21 starts counting and, when a prescribed amount of elapsed time is detected, a high-level signal is output to the 0 terminal.

This signal is shifted to low-level in passing through the inverter 24 and is then applied to the gate of the transistor Tr2 that joins the voltage regulator circuit 13 and the VSS power supply, placing it in the non-conducting condition, thereby isolating the voltage regulator circuit 13 from the power supply, so that the output voltage Vreg is not generated.

While the hands stop when the stem is pulled out, after a certain period of time elapses, the power supply voltage is no longer supplied to the oscillator circuit 5 and the first frequency dividing circuit 7, so that they stop, the result being that the second frequency dividing circuit 8 also stops, so that the entire circuit stops operating, thereby achieving a condition in which the current consumption is further reduced.

At a later time, if the stem of a watch that had been pulled out is pushed in, the switch SW opens, so that the potential on the ON contact 15 drops to VSS, so that a high-level reset signal is applied to the terminal R of the counting circuit 21, making the level of its output 0 low level, the result being that the gate of the transistor Tr2 changes to a high level, the transistor conducting, so that the voltage regulator circuit 13 is connected to the power supply VSS, this being supplied to the oscillator circuit 5 and the first frequency dividing circuit 7, the signal that had been applied to the stop terminal D of the waveshaping circuit 9 also being changed to the low level, so that the overall operation of the watch is restarted.

In this case, the watch that had been completely stopped, including the oscillator circuit, starts operating once again, so that, as described above, some time is required from the point at which the stem is pushed in until the oscillation of the quartz resonator element to grow and move the hands, after which accurate hand setting is done.

To avoid the stoppage of the oscillation and frequency dividing during normal hand setting, the setting time of the counting circuit 21 is set sufficiently greater than the time required to perform setting of the hands.

Because setting of the hands is normally completed within one or two minutes, it is sufficient to make the setting time of the counting circuit 21 around three minutes, and even if the setting time is made 5 to 10 minutes, this is insignificant in comparison with a period of several days, or a period of storage that can be as much as several weeks or several months.

Even if the setting of the hands requires so much time that the hands stop, it is only necessary to push the stem in to start the watch and perform the setting once again, so that this is no particular problem.

In the configuration shown in FIG. 1, if the stem is pulled out, because the entire circuit stops, a power savings is achieved. During this time, however, the switch SW remains closed, so that a current continues to flow through the transistor Tr1 pull-down resistor.

In the first embodiment, therefore, although there is an improvement over the prior art, because current does not flow through both the oscillator circuit and the pull-down resistance, more power savings are still possible.

However, if the resistance of Tr1 is made large so as to reduce the current, the time constant of the circuit will increase, causing an undesirable delay of the response when the stem is pushed in. Given this, in a second embodiment of the present invention the pull-down resistance value is increased with such as problem, thereby reducing the flow of current.

In the above-noted embodiment, it is desirable that the switch is a reset switch operated by the stem, although this is not applied as a restriction.

Additionally, in a power-saving electronic watch according to the above-noted embodiment, it is desirable that the electronic watch be rechargeable.

It is further desirable in the above-noted embodiment that the oscillator circuit being driven by a voltage regulated power supply.

Next, the second embodiment of a power-saving electronic watch 100 according to the present invention is described in detail below, with reference made to FIG. 2.

Figure 2:
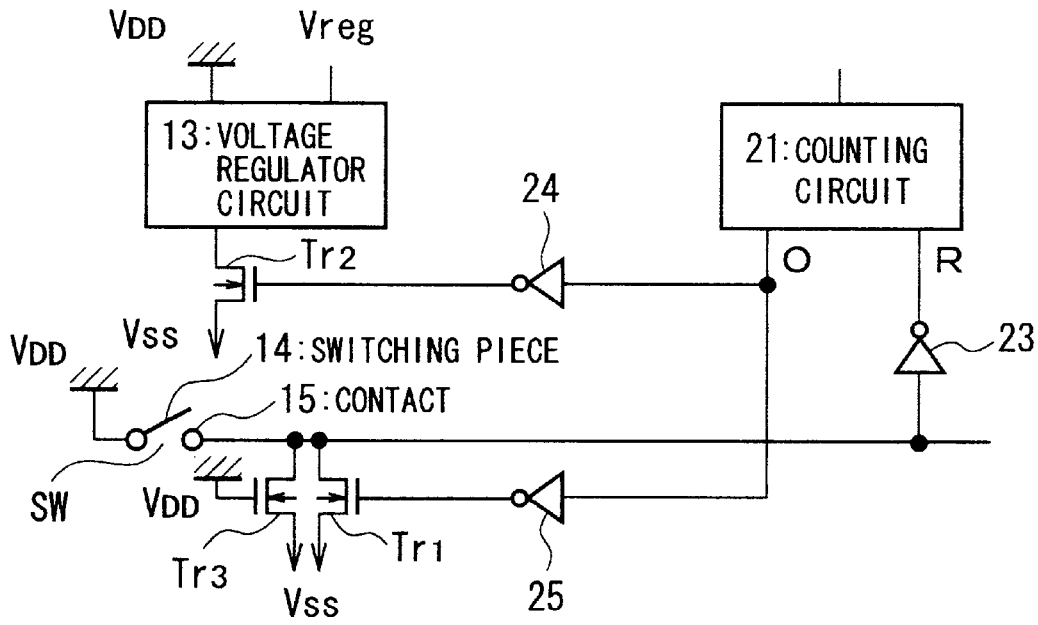
FIG. 2 is a block diagram showing the main part of a second embodiment of an electronic watch according to the present invention.

Specifically, the embodiment of the present invention shown in FIG. 2 shows a configuration in which most components are the same as those shown in FIG. 1, except with a low-resistance element Tr1 and a high-resistance switching element Tr3 connected in parallel with the ON contact 15 of the switch SW, the low-resistance switching element Tr1 being controlled by the counting circuit 21.

That is, in this embodiment, the basic configuration of the watch from the oscillator circuit 5 to the motor 11 and the hands 12, and the configuration of the connection ON contact 15 of the switch SW to the stop terminal D of the waveshaping circuit 9 or to the reset terminal R of the second frequency dividing circuit 9 are the same as the FIG. 1 embodiment, and are thus omitted, the switch SW, the voltage regulator circuit 13, and the counting circuit 21 and the like parts of the configuration being shown.

In FIG. 2, the two transistors Tr1 and Tr3 are connected in parallel to the ON contact 15 of the switch SW as pull-down resistances.

The detection signal from the output terminal 0 of the counting circuit is connected via the inverter 25 to the gate of Tr1, so as to perform on and off control. When Tr1 is conducting, the resistance is approximately the same as Tr1 as shown in FIG. 1.

As described above, during normal watch operation the switch SW is open, with a high-level signal applied to the reset terminal R of the counting circuit 21, so that operation thereof is stopped, the output terminal 0 thereof being at the low-level.

This voltage, via the inverter 25, makes the gate of Tr1 high level, so that the transistor Tr1 conducts.

A transistor having a resistance that is much greater than that of Tr1 is used as Tr3, the gate thereof being connected to VDD so that it is constantly conducting. For example, if the resistance of Tr1 is approximately 10 megohms, that of Tr3 is 100 megohms. Therefore, the combined resistance is close to that of Tr1.

As a result, the operation of pulling out the stem, setting the hands, and pushing the stem in again thereafter the above-noted set time is the same as previously described embodiment. That is, although the hands stop, oscillation continues, so that if the stem is pushed in the watch immediately starts operating normally.

When the stem is pulled out for storage so as to save electrical power, the following operation occurs in the embodiment of FIG. 2. Simultaneously with pulling out the stem, the counting circuit 21 starts counting, and when the prescribed time has elapsed, it outputs a signal to the terminal 0 so as to enter the power-saving condition.

As described above, this signal, via the inverter 24, stops the voltage regulator circuit 13, but in this case the signal on the terminal 0 is also applied via the inverter 25 to the gate of Tr1, so that it is non-conducting. As a result, current no longer flows in Tr1, current flowing only through Tr3 and, because, as noted above, the resistance thereof is large, this consumed current is less than 1/10 of that consumed in the past.

When the stem is pushed in so that the switch SW opens, because Tr1 is in the non-conducting condition while Tr3 conducts, the potential on the ON contact 15 is pulled down, via Tr3, to VSS. Compared to pulling down via Tr1, greater time is required, although this is not a problem as it is different from the case in which the hands of a watch in use are set.

When the potential on the ON contact 15 drops, the terminal R of the counting circuit 21 changes to the high-level, thereby resetting the counting circuit 21, so that the output 0 thereof changes to a low-level, the transistor Tr1 conducting and acting once again as a pull-down resistance thereby causing the restarting of the overall watch.

In this embodiment, although there is a great reduction of the current flowing in the resistance because of order of magnitude increase in the pull-down resistance in the power-saving condition, there is still a minute current continuing to flow, this representing a loss.

Given the above, in a third embodiment of the present invention, in the power-saving condition the pull-down resistance is made a high resistance so that the current flowing is effectively zero.

Figure 3:
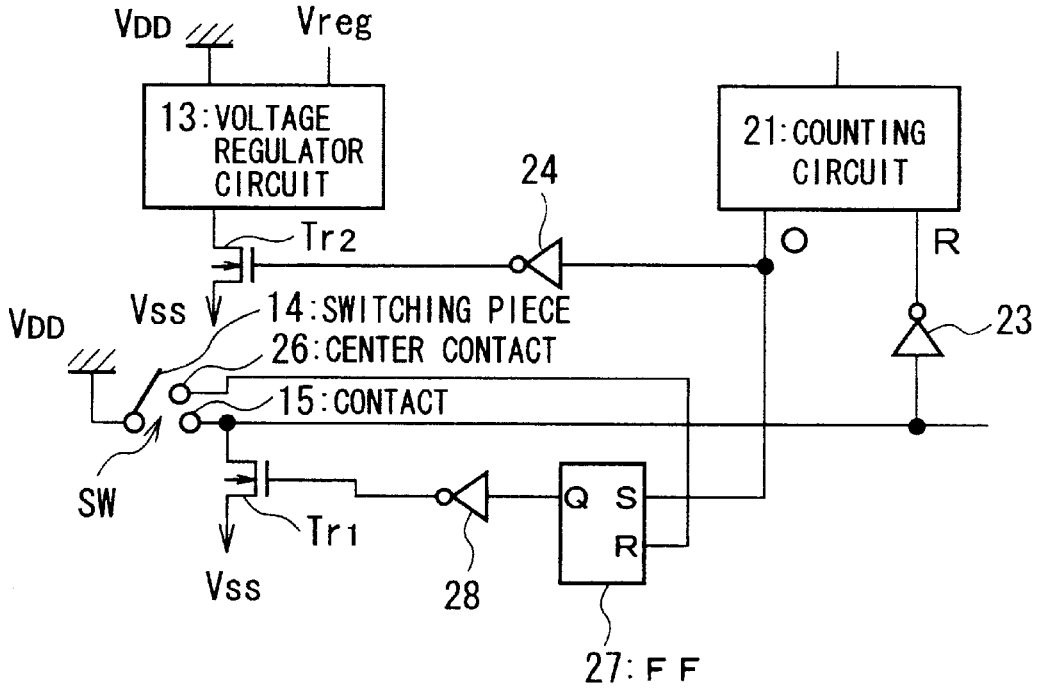
FIG. 3 is a block diagram showing the main part of a third embodiment of an electronic watch according to the present invention.
Figure 4:
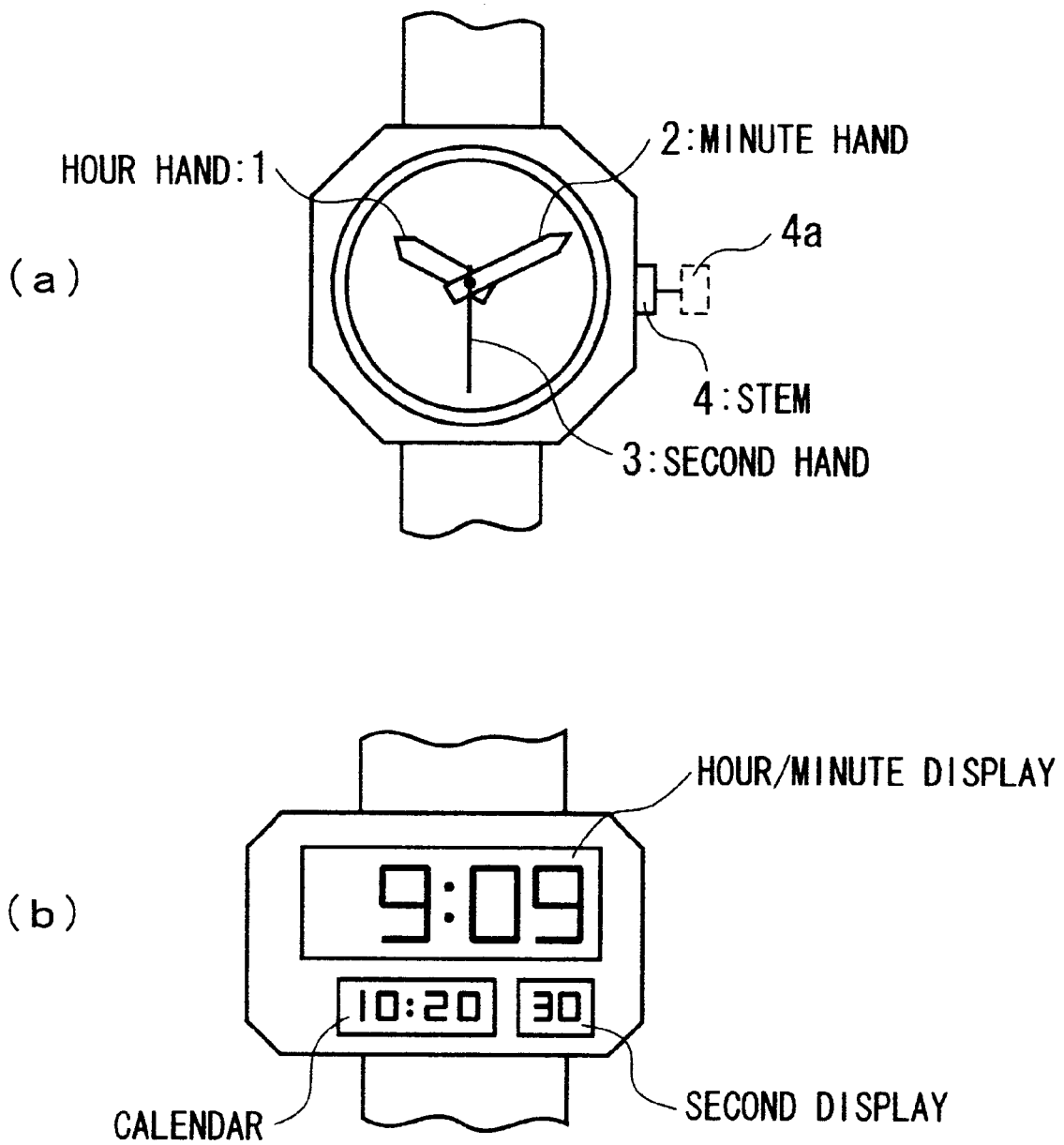
FIG. 4 is an outer view of an electronic watch of the past.

Specifically, FIG. 3 shows the third embodiment of the present invention, which is a power-saving electronic watch 100 having a power supply 13, an oscillator circuit 5, frequency dividing circuits 7 and 8, a drive circuit 10, an externally operable switch SW, and a counting circuit 21 that counts a prescribed time, wherein a switching element Tr1 is connected to the ON contact 15 of the switch SW, and wherein a center contact 26 is provided between the ON contact 15 of the switch SW and the position of the switching piece 14 in the OFF condition of the switch, this center contact 26 controlling the switching element Tr1 of the ON contact 15.

That is, in FIG. 3, because the basic configuration is the same as that of FIG. 1, to simplify the description thereof, only the main circuit parts of this embodiment will be described.

Specifically, in this embodiment a center contact 26 is provided midway in the movement of the switching piece 14 linked to the stem 4.

Therefore, as is the case with the foregoing embodiments, when the stem 4 is pulled out the switching piece 14 contacts the ON contact 15, and when the stem 4 is pushed in the switching piece 14 moves away from the ON contact 15, and midway in the displacement of the switching piece 14 there is temporary contact made with a newly provided center contact 26, so as to apply the VDD power supply thereto.

As is clear from FIG. 3, the pull-down resistance is formed by the one transistor Tr1. A flip-flop (FF) 27 is provided and the center contact 26 of the switch SW is connected to the R terminal of the flip-flop (FF) 27, the output terminal 0 of the counting circuit 21 being connected to the S terminal of the flip-flop (FF) 27. The Q output of the flip-flop (FF) 27 is connected, via the inverter 28, to the gate of the transistor Tr1.

As a result, the operation when the stem 4 is pulled out and the hands set within the above-noted set time is the same as described in the foregoing embodiments, and although the hands stop, oscillation and the like continue, so that if the stem 4 is pushed in, normal hand movement restarts immediately.

Upon pulling out and pushing in the stem 4, the switching piece 14 comes into contact with the center contact 26, and a high-level signal is applied to the reset terminal of the flip-flop (FF) 27, which is usually in the reset condition, so that its Q output is at the low level.

Even after the stem 4 is pulled out, until the set time of the counting circuit 21 elapses, because the same condition continues, so that no change occurs even in the switching piece 14 comes into contact with the center contact 26 during this time.

If the stem 4 is pulled out and left out, the following operation occurs with the configuration shown in FIG. 3.

In the same manner as the foregoing embodiments, simultaneous with pulling out of the stem 4 the counting circuit 21 starts counting, and when a prescribed time has elapsed, outputs a detection signal to the terminal 0, so as to stop the voltage regulator circuit 13, thereby entering the power-saving condition.

The detection signal of the counting circuit 21 is applied also the S terminal of the flip-flop (FF) 27, thereby setting it, so that the Q output thereof changes to a high-level. The Q output via the inverter 28 changes to the low-level, this being applied to the gate of the transistor Tr1, thereby placing it in the non-conducting condition.

By the above action, the Tr1, which is a pull-down resistance, has current flowing therethrough, so that the power saving is substantially maximum.

When storage of the watch is finished and the stem 4 is pushed in, the switching piece 14 moves away from the ON contact 15, so that the switch SW is completely open, as shown in FIG. 3, the switching piece 14 coming into temporary contact with the center contact 26 midway, thereby applying the VDD voltage.

By the above, the flip-flop (FF) 27 is reset, so that its Q output changes to the low-level, the gate of Tr1 changing to the high-level, causing it to conduct and function as a pull-down resistance. By this action, the potential on the ON contact 15 is pulled down, so that the counting circuit 21 is reset, thereby restarting the overall operation of the watch.

Next, a fifth preferred embodiment of the oscillator circuit 5 is described below.

Figure 6:
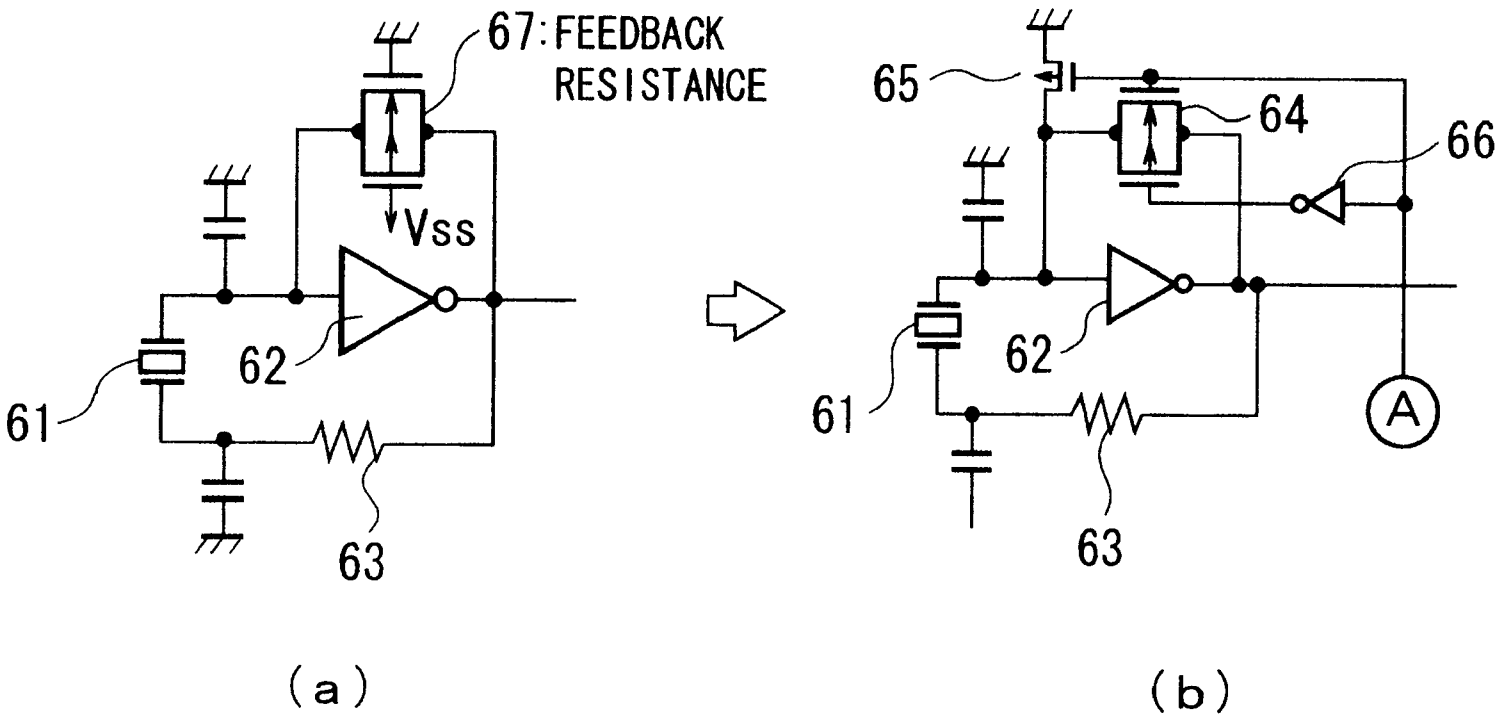
FIG. 6 is a block diagram of a fourth embodiment of an electronic watch according to the present invention.

Specifically, in this embodiment, to more effectively save electrical power in the oscillator circuit 5, as shown in FIG. 6(*a*), a means for stopping the oscillator circuit 5 is configured so as to open a feedback resistance of the oscillator circuit 5, and fix the input potential of the oscillator circuit 5.

Figure 7:
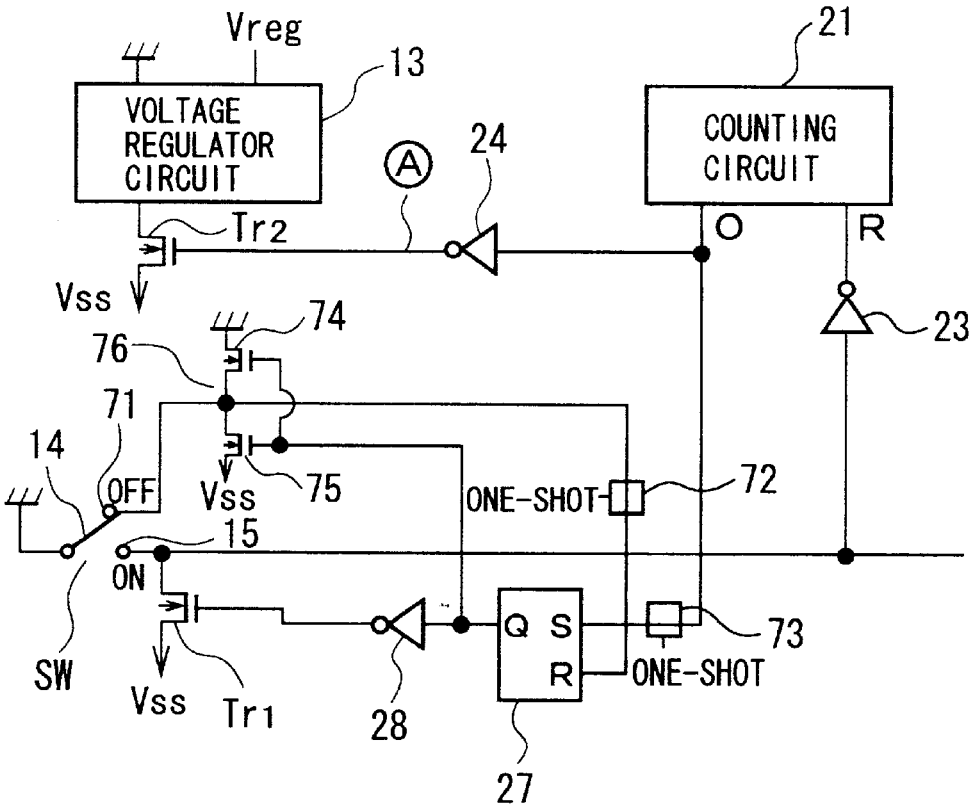
FIG. 7 is a block diagram of the main part of a fifth embodiment of an electronic watch according to the present invention.

That is, as shown in FIG. 6(*a*), in contrast to an oscillator circuit of the past, formed by a feedback resistance 64 formed by a transmission gate using a PMOS transistor and NMOS transistor connected in parallel to an inverter 62 connected to one end of a quartz resonator element 61, and a resistance 63 connected to the other end of the quartz resonator element 61 and the output of the inverter 62, in this embodiment the circuit configuration is one in which a switching transistor 65 is provided between one end of the feedback resistance 64 and a prescribed power supply, the gate of the switching transistor 65 being connected to the gate of the transistor Tr2 shown in FIG. 7, and connected to the other end of the feedback resistance 64, with the inverted signal thereof via the inverter 66 being connected to the other end of the feedback resistance 64.

In this embodiment, therefore, the output of the inverter 24 is usually at the high-level, with the transistor 65 off, and the feedback resistance 64 on.

In this condition, the configuration of FIG. 6(*b*) is the same as that of FIG. 6(*a*).

Thereafter, the stem is pulled out (so that the switching piece 14 connects with the OFF contact 7), when a certain time elapses the output of the inverter 24 changes to the low level.

As a result, the transistor 65 is switched to on, and the feedback resistance 64 becomes a high resistance.

By holding the input to the transistor 65 at the high level, the output of the inverter 62 is fixed at the low level.

In this condition, because the feedback resistance 64 is a high resistance, current does not flow therein. That is, with the gate of the transistor Tr2 changed to the low-level, the oscillator stops, and there is an even greater power savings.

The fifth embodiment of a power-saving electronic watch 10 is described in further detail below.

Specifically, FIG. 7 is a block diagram showing the configuration of the fifth embodiment of a power-saving electronic watch 100, in which a switching element is connected to the ON contact of the switch, a switching element being provided also on the OFF contact of the switch, the counting circuit, the ON contact, and the OFF contact (signals) performing control of the ON contact switching element and the OFF contact switching element.

More specifically with regard to this embodiment, the power-saving electronic watch 100 is an electronic watch with substantially the same circuit configuration as FIG. 1, this being an electronic watch having a power supply 13, an oscillator circuit 5 including a quartz resonator element 6, frequency dividing circuits 7 and 8, a drive circuit 10, an externally operable switch SW, and a counting circuit 21 that counts a prescribed time, wherein a first switching element Tr1 is connected to the ON contact 15 of the switch SW and a second switching element 76 is connected to the OFF contact 71 of the switch SW, the second switching element 76 performing control of the switching element Tr1 of the ON contact 15.

As is clear from FIG. 7, the configuration and connection relationship of the voltage regulator circuit 13 and the counting circuit 21 in this embodiment are substantially as shown in FIG. 1, the details thereof being omitted herein, and only the characteristic circuit configuration of this embodiment being described.

Specifically, in this embodiment, two contacts, an ON contact 15 and an OFF contact 71, are provided that can make contact with the switching piece 14 of the switch SW, the ON contact 15 being provided, the same as in the case shown in FIG. 3, with a first switching element Tr1, formed by an n-type transistor, as a pull-down resistance, the gate of the n-type transistor being connected to the output terminal Q of the flip-flop 27 via the inverter 28, the set terminal S of the flip-flop 7 being connected to the output terminal 0 of the counting circuit 21 via a one-shot circuit 21, the OFF contact 71 being connected via a one-shot circuit 72 to the reset terminal R of the flip-flop 27, a second switching element 76 being provided between the OFF contact 71 and the reset terminal R of the flip-flop 27, the gate of the switching element 76 being connected to the output terminal Q of the flip-flop 27.

In this embodiment of the present invention, the second switching element 76, as shown in FIG. 7 is a series connection of a PMOS transistor 74 and an NMOS transistor 75, a terminal of the OFF contact 71 and the Q output terminal of the flip-flop 27 being connected to the connection point between the transistors 74 and 75.

The operation of the above-noted circuit of this embodiment is such that, in the initial condition the switching piece 14 is connected to the OFF contact 71, the flip-flop 27 being in the reset condition (Q output at the low level).

The transistor Tr4 is on, the transistor 75 is off, and Tr1 is on.

Although the switching piece 14 is connected to the OFF contact 71, because Tr4 is on and the transistor 75 is off, switch current does not flow.

Additionally, because Tr1 is on, the ON contact 15 is at the low level, and the inverter 23 output is at the high level, so that the counting circuit 21 is in the reset condition.

Because the output 0 of the counting circuit 21 is low, Tr2 is on, and the voltage regulator circuit 13 supplies power via Tr2, so that operation occurs (normal condition).

In this condition, if the stem is pulled out, the switching piece 14 moves from the OFF contact 71 to the ON contact 15.

As a result, the ON contact 15 changes to the high-level, so that a reset is made of the waveshaping circuit 9 or second frequency dividing circuit 8 shown in FIG. 1, thereby stopping the movement of the hands. The reset of the counting circuit 21 is released, via the inverter 23, so that counting is started.

When the counting circuit 21 completes counting, the 0 output changes to high-level, and, via the inverter 24, Tr2 is switched off, the voltage regulator circuit 13 supply of power is cut off, thereby causing a stoppage.

When the output of the counting circuit 21 changes from low to high, the one-shot circuit 73 generates a signal, the flip-flop 27 is reset, and the Q output changes to high level (the one-shot circuits 72 and 73 generate signals when an input changes from low to high).

The transistors 74 and 75 are switched on, and Tr1 is switched off.

Although the switching piece 14 is connected to the ON contact 71, because Tr1 is off, switch current does not flow. The OFF contact 71, because the transistor 75 is off, is at the low level.

In this condition, because switch current does not flow and the oscillator circuit is stopped, there is in principle absolutely no consumed current flow.

Thereafter, when the stem is pushed in, the switching piece 14 moves from the ON contact 15 to the OFF contact 71, so that the OFF contact 71 changes to the high-level, a signal being output from the one-shot circuit 72, thereby resetting the flip-flop 27, the Q output of which changes to low, thereby representing return to the initial condition.

By the above-noted operation, with the stem pulled out, there is in principle absolutely no consumed current flowing, and in this condition the effect achieved is that there is absolutely no depletion of the battery.

Figure 8:
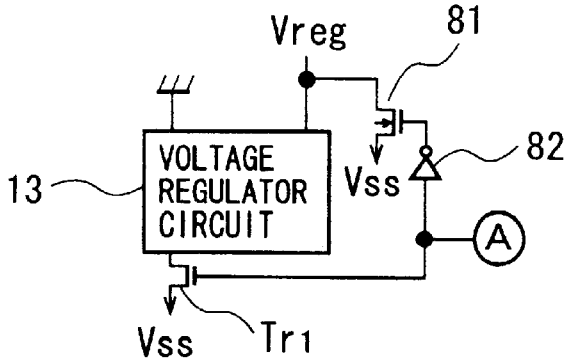
FIG. 8 is a block diagram showing the main part of a sixth embodiment of an electronic watch according to the present invention.

Next, in a sixth embodiment of the present invention, as shown in FIG. 8, a feature of the configuration is the configuration of the oscillator circuit, the oscillator circuit in this case being that shown in FIG. 1, but in which drive is done by a voltage regulator circuit, which is configured so as to output a power supply voltage when the oscillator circuit is stopped.

As shown in FIG. 7, the voltage regulator circuit 13 in this embodiment has basically the same configuration as the voltage regulator circuit 13 in the foregoing embodiments, the difference in the configuration of which being the provision of an NMOS transistor 81 between the output terminal of the voltage regulator circuit for the oscillator circuit 5 and VSS, the gate of the transistor 81 being connected also to the gate of the NMOS transistor Tr2 via an inverter 82.

The inverted signal from the output terminal 0 of the counting circuit 21 is connected to the gate terminal of the NMOS transistor Tr2.

The operation of the above-noted circuit in this embodiment is such that, when the gate terminal of the NMOS transistor Tr2 is high, that is, in the normal condition, the transistor Tr1 is on and transistor 81 is off, so that the configuration is, for example, such as shown in FIG. 7.

However, when the gate terminal of the NMOS transistor Tr2 is low, transistor Tr1 is off and transistor 81 is on, so that the output Vreg of the voltage regulator circuit 13 is the potential VDD.

In the configuration of FIG. 1, because the output Vreg of the voltage regulator circuit 13 is indeterminate (high impedance), the output of the first frequency dividing circuit 7 is also indeterminate, so that there are cases in which the input of the second frequency dividing circuit 8 which inputs this signal becomes indeterminate. By means of this operation, however, the output of the first frequency dividing circuit 7 becomes stable, enabling the effect of achieving overall stable circuit operation.

Next, a ninth embodiment of a power-saving electronic watch 100 according to the present invention is described below.

Specifically, in the case in which a further power savings is required, such as the case in which the voltage of the power supply of the electronic watch, such as the voltage of a battery drops below a pre-established voltage level, there is a need to use a more effective power-saving function in this condition as well.

For this reason, in the seventh embodiment of the present invention, the voltage of the power supply or the remaining capacity is constantly detected at a prescribed timing, the oscillator circuit of the electronic watch 100 being stopped, based on this detection signal.

Figure 9:
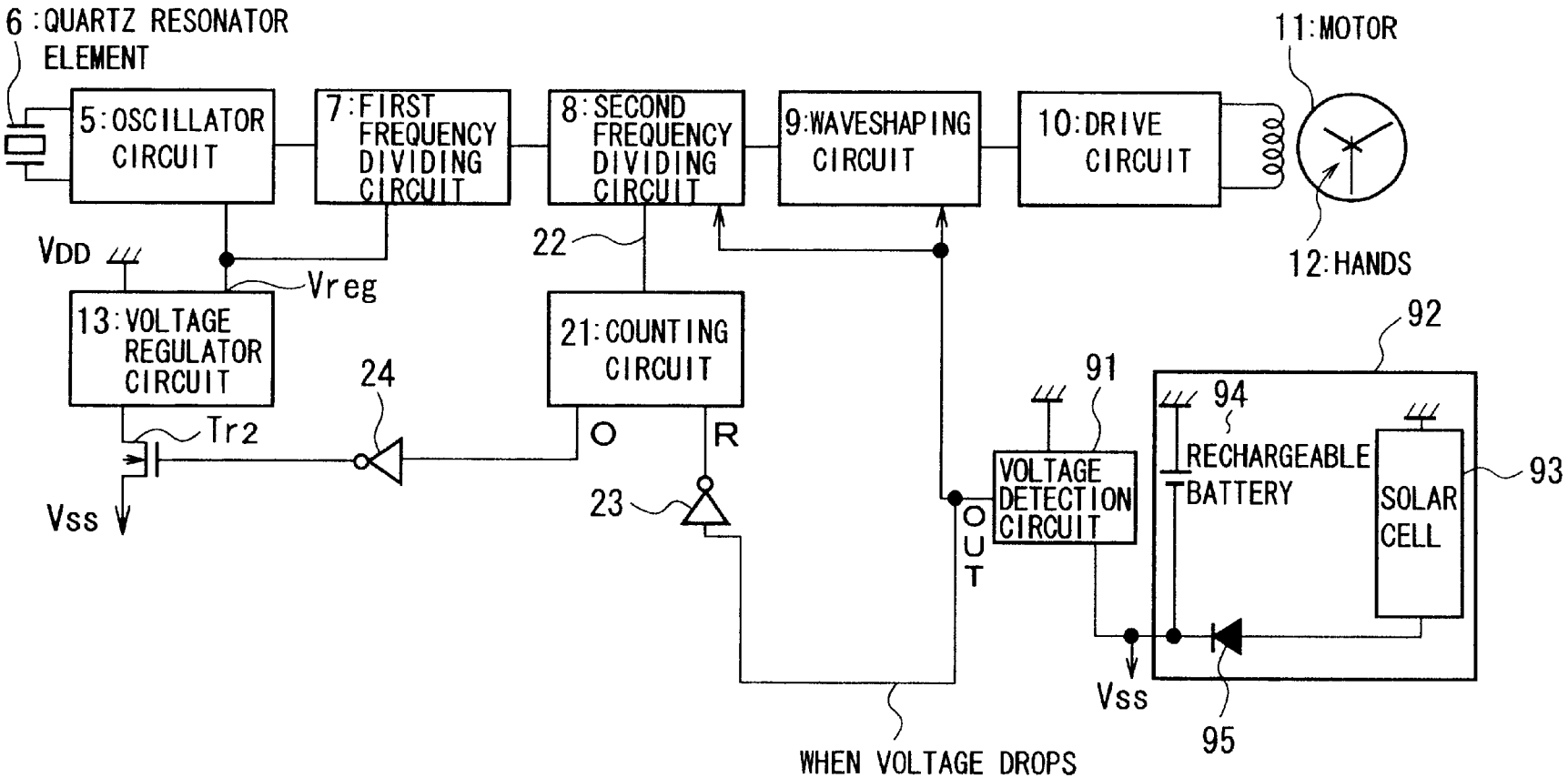
FIG. 9 is a block diagram showing the main part of a seventh embodiment of an electronic watch according to the present invention.

That is, FIG. 9 shows an electronic watch 100 having a power supply 92, a voltage regulator circuit 13, an oscillator circuit 5, frequency dividing circuits 7 and 8, and a drive circuit 10, and further has a voltage detection circuit 91 that detects a drop in power supply voltage, wherein an output signal from the voltage detection circuit 91 minimally stops the oscillator circuit 5.

That is, in this embodiment the power supply can be a primary cell or a secondary cell, and the power supply 92 can also be a power supply formed by an electrical generator and a secondary cell.

It is possible, for example, to use a solar cell, an automatic electrical generator using a mechanical mechanism, or a thermo-electric generator which makes use of a temperature difference as electrical generator in the present invention.

In the embodiment of FIG. 9, the example shown is that of a power supply 92 that is a combination of a solar cell 93 and a secondary cell 94.

That is, FIG. 9 shows an electronic watch 100 having a power supply 92, a voltage regulator circuit 13, an oscillator circuit 5 including a quartz resonator element 6, frequency dividing circuits 7 and 8, and a drive circuit 10, in which a voltage detection circuit 91 is provided that detects the output voltage of the power supply 92 either constantly or at a prescribed timing, the output signal from the voltage detection circuit 91 being input via the inverter 24 to the gate an NMOS transistor Tr2 connected to the power supply voltage VSS.

In this embodiment of the present invention, in some cases the output signal of the voltage detection circuit 91 can be input to the reset terminal of the counting circuit 21 shown in FIG. 1, and after the prescribed count-up has been made, the output of the counting circuit 21 being input to the inverter 24.

By adopting the above-described circuit configuration, this embodiment operates as described below.

That is, the power supply 92 is constituted by a solar cell 93, a diode 95, and secondary cell (rechargeable battery) 94.

When light is shone onto the solar cell 93, the solar cell 93 generates electricity, and charges the secondary cell 94 via the diode 95.

If light is not shone onto the solar cell 93 for a long time, the capacity of the secondary cell 94 gradually decreases.

The voltage detection circuit 91 measures the voltage of the secondary cell 94 and, in the case in which this voltage falls below a specified voltage (a voltage with a slight margin above the minimum voltage necessary to operate this system), a high-level fixed-voltage signal is generated.

When this occurs, the counting circuit 21 is reset via the inverter 23, after which operation is the same as FIG. 1.

In this embodiment, if light is shone onto the solar cell 93 and the voltage of the secondary cell 94 rises, the voltage detection circuit 91 measures the voltage of the secondary cell 94 and outputs a low-level fixed-voltage signal.

Thereafter, operation is the same as FIG. 1.

That is, the ON contact 15 of FIG. 1 has the same action as the voltage detection circuit 91 shown in FIG. 9.

If the counting circuit 21 is eliminated and the voltage detection circuit 91 detects a drop of voltage below a specified voltage, it is possible to stop the oscillation immediately.

By this operation, the clock is stopped when the voltage drops, after which depletion of the battery is prevented. Thus, if charging is done again by the solar cell 93, it is possible to immediately to raise the voltage to above the specified voltage, and to start the watch operation quickly.

As is clear for the foregoing description, according to the present invention, in addition to allowing setting of the hands by the stem as is done with a watch of the past, by pulling out the stem when the watch is in the delivery or stored in a shop, it is possible to greatly reduce the current consumption, thereby preventing depletion of the battery.

That is, in the past, although pulling out the stem during storage stopped the hands, oscillator circuit and frequency dividing continued, so that current was still consumed, whereas with the present invention the circuit operation is also stopped. Additionally, the pull-down resistance in the power-saving condition is made large, so as to reduce the current flow, thereby providing an even further saving of power.

Additionally, by making the pull-down resistance a non-conducting condition, it is possible to make the current flow substantially zero, thereby providing the maximum power savings.

Additionally, in the present invention, in addition to the above-described power savings during a time setting operation or when storing an electronic watch, in a normal use condition as well if the voltage droops below a prescribed reference voltage level, it is possible to enter the power-saving mode automatically, thereby enabling use with the user needing to be aware of either the voltage level of the power supply or the remaining capacity, and by giving some verifiable notification by some means that the power-savings mode has been entered, use is possible without any practical inconvenience.

While the foregoing embodiments were described for the example of a so-called analog watch, in which hands indicate the time, it will be readily understood by a person skilled in the art that the present invention can be applied as well to a digital display type watch using an electro-optical element such as a liquid-crystal or the like, wherein a switch operation for more than a prescribed amount time causes the oscillator circuit to stop and the display to be blanked.

In the case of a digital watch, it is possible in each circuit to input a signal of the second frequency dividing circuit, with the drive signal of each circuit being input to the digital display device, thereby constituting an embodiment of a digital display.

What is claimed is:

1. In an electronic watch comprising a power supply, an oscillator circuit, a frequency dividing circuit, and a drive circuit, a power-saving electronic watch comprising an externally operable switch and a counting circuit that counts a prescribed time, wherein after said switch goes into an ON condition and after a prescribed amount of time elapses, the configuration is such that a supply of electrical power at least to said oscillator circuit is stopped so as to stop operation of said oscillator circuit, and further wherein a low-resistance switching element and a high-resistance switching element are connected in parallel to an ON contact of said switch, with said counting circuit controlling said low-resistance switching element.

2. In an electronic watch comprising a power supply, an oscillator circuit, a frequency dividing circuit, and a drive circuit, a power-saving electronic watch comprising an externally operable switch and a counting circuit that counts a prescribed time, wherein after said switch goes into an ON condition and after a prescribed amount of time elapses, the configuration is such that a supply of electrical power at least to said oscillator circuit is stopped so as to stop operation of said oscillator circuit, and further wherein a switching element is connected to an ON contact of said switch, a center contact being provided between said ON contact of said switch and an off position of said switch, with said center contact controlling said switching element at said ON contact.

3. In an electronic watch comprising a power supply, an oscillator circuit, a frequency dividing circuit, and a drive circuit, a power-saving electronic watch comprising an externally operable switch and a counting circuit that counts a prescribed time, wherein after said switch goes into an ON condition and after a prescribed amount of time elapses, the configuration is such that a supply of electrical power at least to said oscillator circuit is stopped so as to stop operation of said oscillator circuit, and further wherein a switching element is connected to an ON contact of said switch, a switching element being connected also to an OFF contact of said switch, with signals of said counting circuit, said ON contact, and said OFF contact controlling said switching element at said ON contact and said switching element at said OFF contact.

4. In an electronic watch comprising a power supply, an oscillator circuit, a frequency dividing circuit, and a drive circuit, a power-saving electronic watch comprising an externally operable switch and a counting circuit that counts a prescribed time, wherein after said switch goes into an ON condition and after a prescribed amount of time elapses, a feedback resistance of said oscillator circuit is opened, and an input potential of said oscillator circuit is fixed so as to stop operation of said oscillator circuit.

5. A power-saving electronic watch according to claim 4, wherein a low-resistance switching element and a high-resistance switching element are connected in parallel to an ON contact of said switch, and wherein said counting circuit controls said low-resistance switching element.

6. A power-saving electronic watch according to claim 4, wherein a switching element is connected to an ON contact of said switch, and wherein a center contact is provided between said ON contact and off position of said switch, said center contact controlling said switching element at said ON contact.

7. A power-saving electronic watch according to claim 4, wherein a switching element is connected to an ON contact of said switch, and wherein a switching element is connected also to an OFF contact of said switch, with said signal of said ON contact, said OFF contact and said counting circuit controlling said switching element at said ON contact and said switching element at OFF contact.

8. A power-saving watch according to any one of claims 1 to 4 or any one of claims 5 to 7, wherein said switch is a reset switch that operates by operation of a stem of said watch.

9. A power-saving electronic watch according to any one of claims 1–4 and 5–7, wherein said electronic watch is a rechargeable type.

10. A power-saving electronic watch according to any one of claim 4 and claims 5 to 7, wherein said oscillator circuit is driven by a regulated voltage power supply, and wherein when said oscillator circuit is stopped, said regulated voltage power supply outputs a power supply voltage.

11. A method for operating an electronic watch comprising a power supply, an oscillator circuit, a frequency dividing circuit, and a drive circuit, with said electronic watch further comprising an externally operable switch and a counting circuit that counts a prescribed time, wherein after said externally operable switch goes into an ON condition and after a prescribed amount of time elapses, the configuration is such that at least said oscillator circuit is stopped, and further wherein a low-resistance switching element and a high-resistance switching element are caused to be connected in parallel to an ON contact of said switch, and said low-resistance switching element is controlled by said counting circuit.

12. A method for operating an electronic watch according to claim 11, wherein said high-resistance switching element is configured so as to be constantly in a conductive condition.

13. A method for operating an electronic watch according to claim 8, 11 or 12, wherein said electronic watch comprising a power supply, an oscillator circuit, a frequency dividing circuit, and a drive circuit, with said electronic watch further comprising an externally operable switch and a counting circuit that counts a prescribed time, wherein after said externally operable switch goes into an ON condition and after a prescribed amount of time elapses, the configuration is such that at least said oscillator circuit is stopped, and wherein a switching element is connected to an ON contact of said switch, while a center contact being provided between said ON contact of said switch and said off position of said switch, and further wherein when said a switching piece of said switch moves between ON and OFF contacts, it makes contact with said center contact of said switch, with contact of said switching piece with said center contact controlling said switching element at ON contact.

14. A method for operating an electronic watch comprising a power supply, an oscillator circuit, a frequency dividing circuit, and a drive circuit, and said electronic watch comprising an externally operable switch and a counting circuit that counts a prescribed time, wherein after said externally operable switch goes into an ON condition and after a prescribed amount of time elapses, the configuration is such that at least said oscillator circuit is stopped, and a switching element is connected to an ON contact of said switch and a switching element is connected as well to an OFF contact of said switch, and wherein signals of said counting circuit, said ON contact, and said OFF contact control said ON contact switching element and said OFF contact switching element.

15. A method for operating an electronic watch comprising a power supply, an oscillator circuit, a frequency dividing circuit, and a drive circuit, said electronic watch comprising an externally operable switch and a counting circuit that counts a prescribed time, wherein after said externally operable switch goes into an ON condition and after a prescribed amount of time elapses, the configuration is such that feedback resistance of said oscillator circuit is opened, and an input potential to said oscillator circuit is fixed, thereby stopping operation of said oscillator circuit.

16. A method for operating an electronic watch according to any one of claims 11, 12, 14 and 15, wherein said switch is a reset switch operated by operation of a stem of said watch.

17. A method for operating an electronic watch according to any one of claims 11, 12, 14 and 15, wherein said electronic watch is a rechargeable type.

18. A method for operating an electronic watch according to any one of claims 11, 12, 14 and 15, wherein said oscillator circuit is driven by a regulated voltage power supply, and wherein when said oscillator circuit is stopped, said regulated voltage power supply outputs a power supply voltage.

* * * * *

UNITED STATES PATENT AND TRADEMARK OFFICE

CERTIFICATE OF CORRECTION

PATENT NO. : 6,542,440 B1
DATED : April 1, 2003
INVENTOR(S) : Hiroyuki Kihara

It is certified that error appears in the above-identified patent and that said Letters Patent is hereby corrected as shown below:

Column 3,
Line 16, delete "." after "the"

Column 16,
Line 34, delete "8, 11, or 12" and insert -- 11 or 12 --

Signed and Sealed this

Sixth Day of January, 2004

JAMES E. ROGAN
*Director of the United States Patent and Trademark Office*